US011435048B2

(12) United States Patent
Friesen et al.

(10) Patent No.: US 11,435,048 B2
(45) Date of Patent: Sep. 6, 2022

(54) LIGHTING MODULE OF A LIGHTING UNIT OF A VEHICLE, AND LIGHTING UNIT

(71) Applicant: HELLA GmbH & Co. KGaA, Lippstadt (DE)

(72) Inventors: Paul Friesen, Rheda-Wiedenbrueck (DE); Joerg Sieme, Georgsmarienhuette (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/475,000

(22) Filed: Sep. 14, 2021

(65) Prior Publication Data

US 2021/0404623 A1 Dec. 30, 2021

Related U.S. Application Data

(63) Continuation of application No. PCT/EP2020/055847, filed on Mar. 5, 2020.

(30) Foreign Application Priority Data

Mar. 14, 2019 (DE) ..... 10 2019 106 504.6

(51) Int. Cl.
*F21V 7/04* (2006.01)
*F21S 41/20* (2018.01)
(Continued)

(52) U.S. Cl.
CPC ..... *F21S 41/285* (2018.01); *F21S 41/148* (2018.01); *F21Y 2115/10* (2016.08)

(58) Field of Classification Search
CPC ..... F21S 41/285; F21S 41/148; F21S 41/143; F21S 41/25; F21S 41/28; F21S 41/29; F21S 41/295; F21S 41/47; F21S 45/49; F21S 41/192; F21S 41/141; F21Y 2115/10; F21Y 2105/10; F21V 17/06; F21V 17/104;
(Continued)

(56) References Cited

U.S. PATENT DOCUMENTS 9,328,889 B2 5/2016 Anzai
9,664,847 B2 5/2017 Krenn et al.
(Continued)

FOREIGN PATENT DOCUMENTS

DE 102014103379 A1 9/2015
DE 102017115652 A1 1/2019
(Continued)

OTHER PUBLICATIONS

International Search Report dated May 29, 2020 in corresponding application PCT/EP2020/055847.

*Primary Examiner* — Omar Rojas Cadima
(74) *Attorney, Agent, or Firm* — Muncy, Geissler, Olds & Lowe, P.C.

(57) ABSTRACT

A light module of a light unit of a vehicle, having a light generating unit, an optical system, a cover plate, a cover frame and a carrier, wherein in an assembled state of the light module, the light generating unit, the optical system and the cover plate are arranged in the aforementioned order between the carrier and the cover frame, and wherein the cover frame has a plurality of positioner for positioning the light generating unit, the optical system and the cover plate relative to the cover frame.

16 Claims, 10 Drawing Sheets

(51) Int. Cl.
*F21S 41/148* (2018.01)
*F21Y 115/10* (2016.01)

(58) Field of Classification Search
CPC .... F21V 17/108; F21V 17/162; F21V 17/164; F21V 17/168; F21K 9/00
See application file for complete search history.

(56) References Cited

U.S. PATENT DOCUMENTS

| | | | | |
|---|---|---|---|---|
| 10,006,602 | B2 | 6/2018 | Abe | |
| 10,139,070 | B2 | 11/2018 | Reitegger et al. | |
| 10,564,381 | B2 | 2/2020 | Oshima et al. | |
| 2008/0273325 | A1* | 11/2008 | Wilcox | F21V 31/005 362/240 |
| 2015/0124469 | A1* | 5/2015 | Krenn | G02B 6/0008 362/511 |
| 2015/0285455 | A1 | 10/2015 | Sudahl | |
| 2015/0377440 | A1* | 12/2015 | Reitegger | F21S 41/25 362/520 |
| 2019/0204528 | A1* | 7/2019 | Oshima | F21V 17/162 |

FOREIGN PATENT DOCUMENTS

| | | | |
|---|---|---|---|
| EP | 2327926 | A1 | 6/2011 |
| EP | 2693109 | A2 | 2/2014 |
| EP | 2796772 | A2 | 10/2014 |
| EP | 2998643 | A1 | 3/2016 |
| WO | WO2013166535 | A2 | 11/2013 |
| WO | WO2014124477 | A1 | 8/2014 |
| WO | WO2018012530 | A1 | 1/2018 |

* cited by examiner

LIGHTING MODULE OF A LIGHTING UNIT OF A VEHICLE, AND LIGHTING UNIT

This nonprovisional application is a continuation of International Application No. PCT/EP2020/055847, which was filed on Mar. 5, 2020, and which claims priority to German Patent Application No. 10 2019 106 504.6, which was filed in Germany on Mar. 14, 2019, and which are both herein incorporated by reference.

BACKGROUND OF THE INVENTION

Field of the Invention

The present invention relates to a light module of a light unit of a vehicle and a light unit of a vehicle.

Description of the Background Art

Such light modules of light units and light units of vehicles are already known from the prior art in numerous variants.

This is where the present invention starts.

SUMMARY OF THE INVENTION

It is therefore an object of the present invention to provide to improve a light module of a light unit and said light unit of a vehicle.

This object is achieved by a light module of a light unit of a vehicle, according to which the light module includes a light generating unit, an optical system, a cover plate, a cover frame and a carrier, wherein the light generating unit, the optical system and the cover plate in an assembled state of the light module are arranged in the aforementioned order between the carrier and the cover frame, and wherein the cover frame has a plurality of positioner for positioning the light generating unit, the optical system and the cover plate relative to the cover frame. Furthermore, this object is achieved by a light unit of a vehicle.

A significant advantage of the invention is in particular that a light module of a light unit and such a light unit of a vehicle are improved. The inventive light module allows for a very precise positioning of the individual components of the light module, so that proper functioning of the light module and thus the light unit of the vehicle equipped with the light module is ensured with low design cost despite unavoidable component tolerances. This is possible by referencing the components of the light module relevant for the proper light function of the inventive light module to a single reference part, namely the cover frame. Via the positioning aids, i.e., the respective positioner, the individual components of the light module can be referenced to the reference part of the light module, so that component tolerances when the light module is assembled do not lead to incorrect positioning and alignment of the light module in an undesired manner. Accordingly, all parts relevant for the light function of the light module, including the holding device of the light module, reference to the reference part, namely the cover frame of the light module.

The plurality of positioners can have a first positioner for positioning the cover plate relative to the cover frame, wherein the first positioner is designed and arranged in such a way that they position the cover plate in a plane perpendicular to a main light direction of the light generated by the light generating unit. This allows for a precise positioning of the cover plate perpendicular to the main light direction of the light generating unit, relative to the cover frame. The cover plate can only be designed as a light-permeable sealing element. However, it is also conceivable that the cover plate has an additional or alternative optical function. Accordingly, the cover plate would be formed as a secondary optical system, while the inventive optical system would be formed as so-called primary optical system.

The cover plate can be fixable and positionable on the cover frame parallel to the main light direction via a first positioning device of the light module. In this way, the cover plate is not only oriented perpendicular to the main direction of light relative to the cover frame, but the cover plate is also aligned parallel to the main direction of light relative to the cover frame. Preferably, the first positioning device is formed in one piece. The first positioning device may be formed as an elastic sheet metal part, for example made of sprung steel.

The plurality of positioners can have a second positioner to position the optical system relative to the cover frame, wherein the second positioner are formed and arranged in such a way that these position the optical system in a plane perpendicular to the main light direction of the light generated by the light generating unit. This also allows for a precise positioning of the optical system perpendicular to the main light direction of the light generating unit relative to the cover frame. The optical system can be formed as the only optical system of the light module. However, it is also conceivable that the cover plate also has an optical function. Accordingly, the cover plate would be formed as a secondary optical system, while the inventive optical system would be formed as a so-called primary optical system. In addition, it is possible that the light generating unit itself includes optical elements.

The optical system can be fixable and positionable on the cover frame parallel to the main light direction via a second positioning device of the light module, preferably that the second positioning device is formed as the first positioning device. As a result, the optical system, analogous to the cover plate, is also aligned parallel to the main direction of light relative to the cover frame. Analogous to the first positioning device, the second positioning device can be formed in one piece, for example as a sprung sheet metal part, i.e., a sheet metal part made of sprung steel. Accordingly, a preferred embodiment of this further development provides that the second positioning device is formed as the first positioning device. Thus, the number of components is reduced, so that transport, storage, and assembly of the inventive light module are simplified. In addition, this saves costs.

The plurality of positioner can have third positioners for positioning the light generating unit relative to the cover frame, wherein the third positioners are designed and arranged in such a way that these position the light generating unit in a plane perpendicular to the main light direction of the light generated via the light generating unit. As a result, the light generating unit, analogous to the cover plate and the optical system, can be positioned precisely perpendicular to the main light direction of the light generating unit relative to the cover frame.

An advantageous further development of the aforementioned embodiment of the light module of the invention provides that the light generating unit is fixable and positionable via a third positioning device of the light module parallel to the main light direction on the cover frame, preferably, that the third positioning device is formed as the carrier. In this way, the light generating unit, analogous to the cover plate and the optical system, is aligned parallel to the main direction of light relative to the cover frame. Via the preferred embodiment of this further development, namely that the third positioning device is formed as the carrier, the number of components is further reduced, so that transport, storage, and assembly of the inventive light module are further simplified. Moreover, this saves additional costs.

In principle, the respective positioning device is freely selectable within wide, suitable limits according to type, function, material, dimensioning and arrangement. This also applies to the first and second positioning devices. Advantageously, the first and/or the second positioning device are designed such that the respective positioning device latches with the cover plate and/or the optical system. As a result, the cover plate and/or the optical system can be fixed in the desired position parallel to the main light position relative to the cover frame in a structurally simple manner.

An advantageous further development of the latter embodiment of the inventive light module provides that the respective positioning device on the one side and the cover frame or the carrier on the other side each have a mutually corresponding securing device, wherein the mutually corresponding securing device secure the respective latching mechanism in the assembled state of the light module. In this way, the first and/or the second positioning device serve to additionally secure the aforementioned latching mechanism of the cover plate and/or optical system against an unwanted loosening of the latching mechanism. Accordingly, the invention according to the present further development is advantageously applicable even under difficult operating conditions.

A further advantageous further development of the light module of the invention provides that the plurality of positioner have fourth positioner for positioning a holding device of the light module for holding the light module on the rest of the light unit relative to the cover frame, wherein the fourth positioner are formed and arranged in such a way that these position the holding device in a plane perpendicular to the main light direction of the light generated via the light generating unit. This additionally ensures that the mechanical connection of the inventive light module is properly positioned and thus aligned with the light unit via the holding device. Accordingly, the holding device also references to the only reference part of the light module, namely the cover frame.

In principle, the positioners, analogous to the positioning devices, are freely selectable within wide, suitable limits according to type, function, material, dimensioning and arrangement. This therefore also applies to the third and fourth positioner. Advantageously, the fourth positioner are formed as the third positioner. In this way, the number of components of the light module is further reduced, so that transport, storage, and assembly of the light module as well as associated costs are further reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
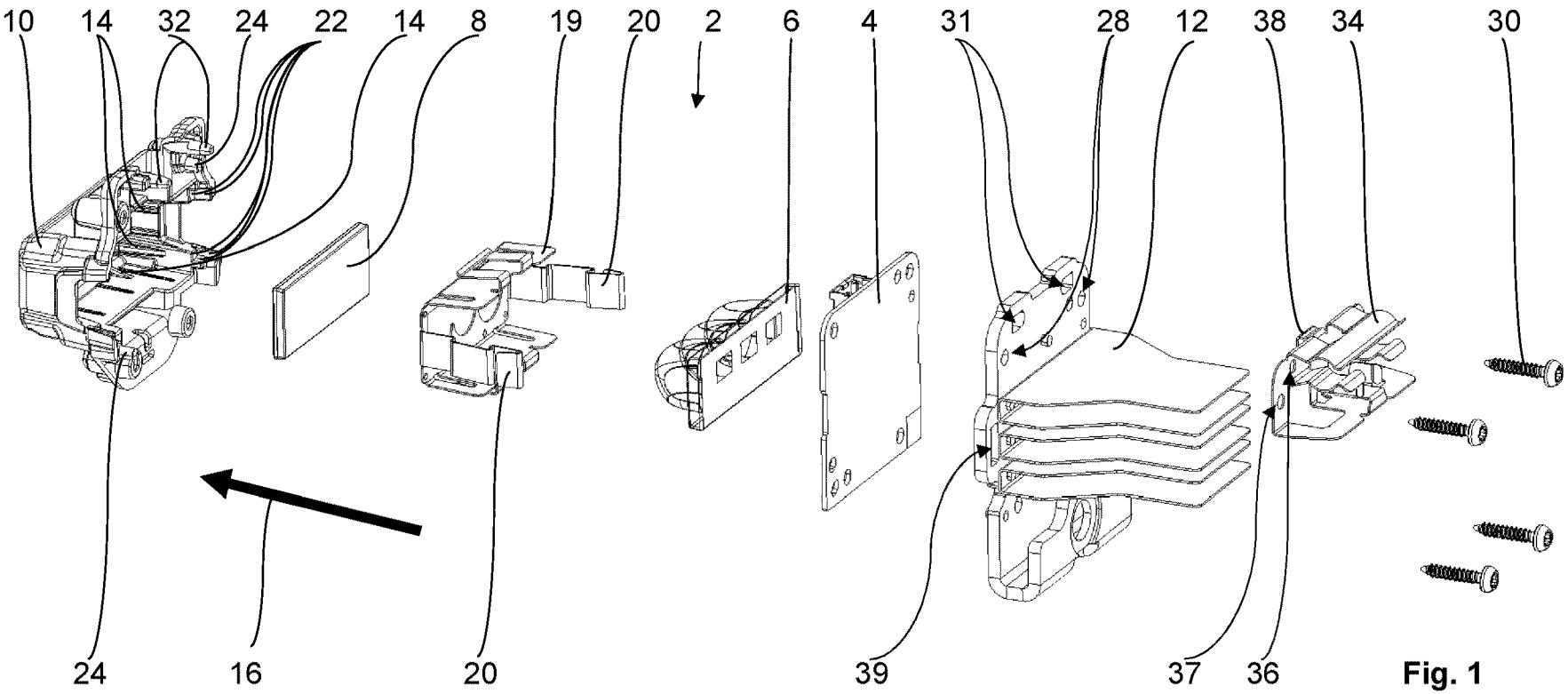
FIG. 1 is an exemplary embodiment of the light module of the invention in a perspective exploded view.

FIG. 1 shows an embodiment of the inventive light module of an inventive light unit of a vehicle by way of example. The vehicle is designed as a passenger car and the light unit is designed as a vehicle headlamp of the vehicle. The vehicle and the light unit are not shown in FIGS. 1 to 10.

The light module 2 comprises a light generating unit 4, an optical system 6 formed as a primary optical system, a cover plate 8 formed as a secondary optical system, a cover frame 10 and a carrier 12 designed as a cooling element. The light generating unit 4 is designed as a printed circuit board with three LEDs arranged on it. The optical system 6 has three individual optical systems assigned to each of the LEDs and is made of glass. The cover plate 8 and the cover frame 10 are each made of plastic. Furthermore, in an assembled state of the light module 2 shown in FIG. 10, the light generating unit 4, the optical system 6 and the cover plate 8 are arranged in the aforementioned order between the carrier 12 and the cover frame 10, wherein the cover frame 10 has a plurality of positioner for positioning the light generating unit 4, the optical system 6 and the cover plate 8 relative to the cover frame 10. The positioner of the cover frame 10 are further described below.

Figure 3:
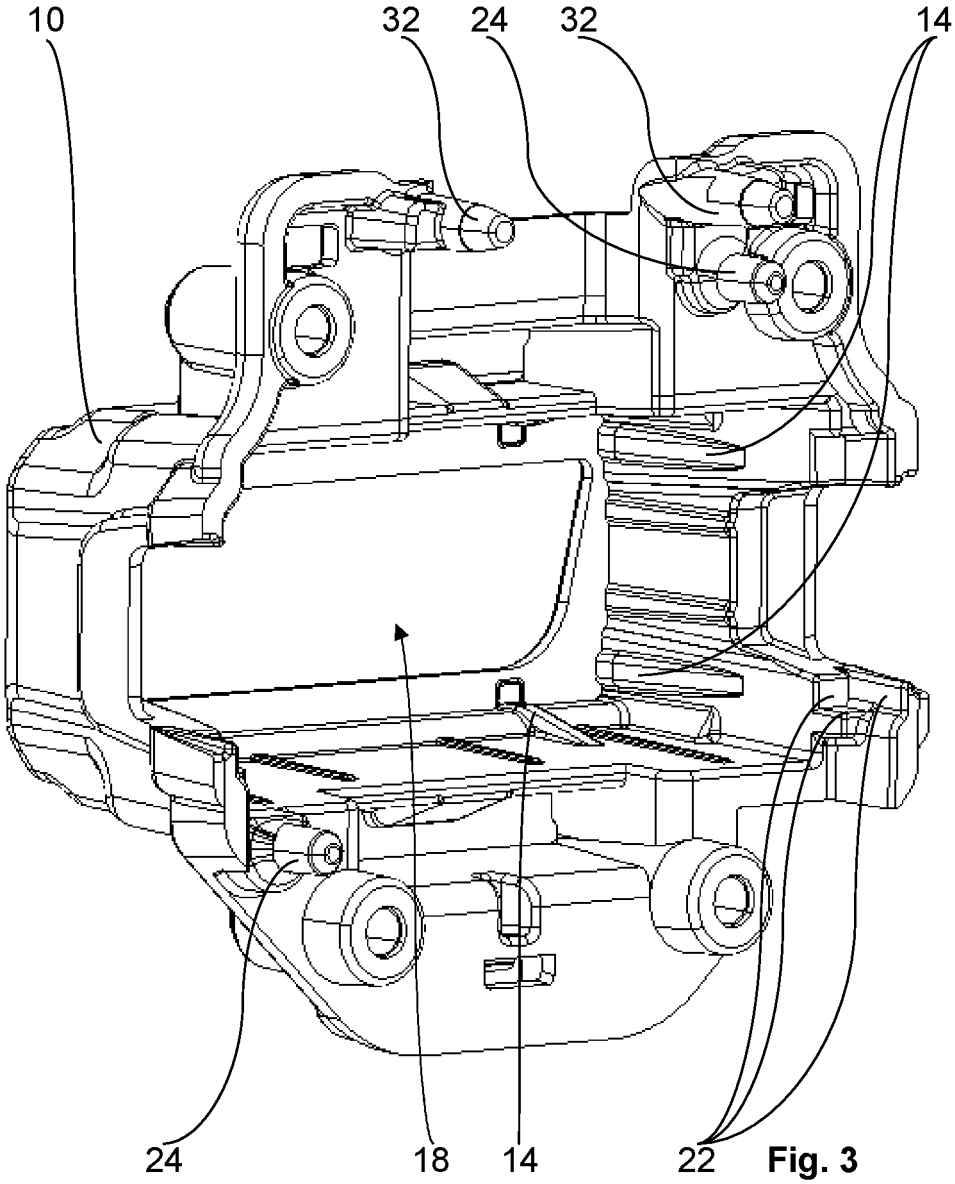
FIG. 3 shows the cover frame of the exemplary embodiment of FIG. 1 in a perspective view of the inner side of the cover frame.
Figure 4:
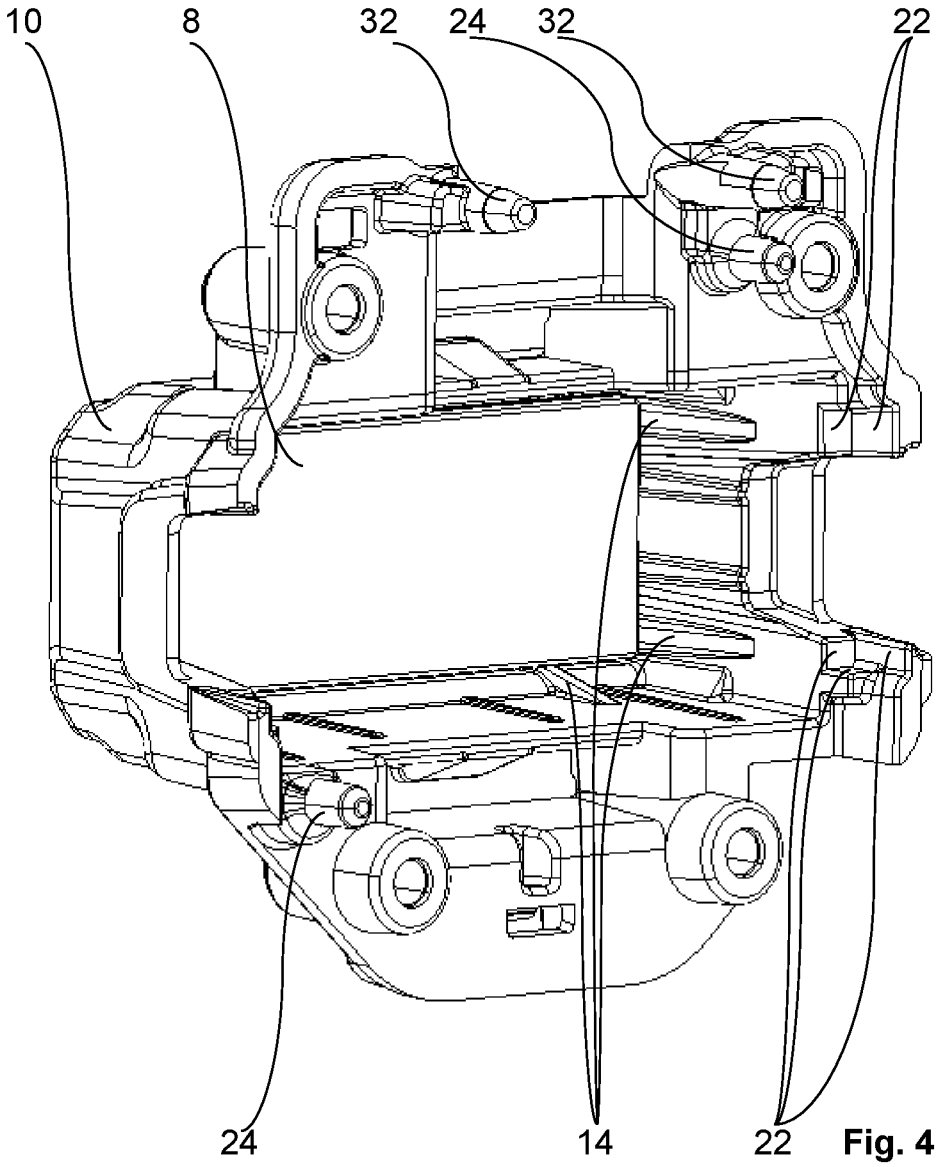
FIG. 4 shows the cover frame of FIG. 3 with the cover plate in a representation comparable to FIG. 3.
Figure 5:
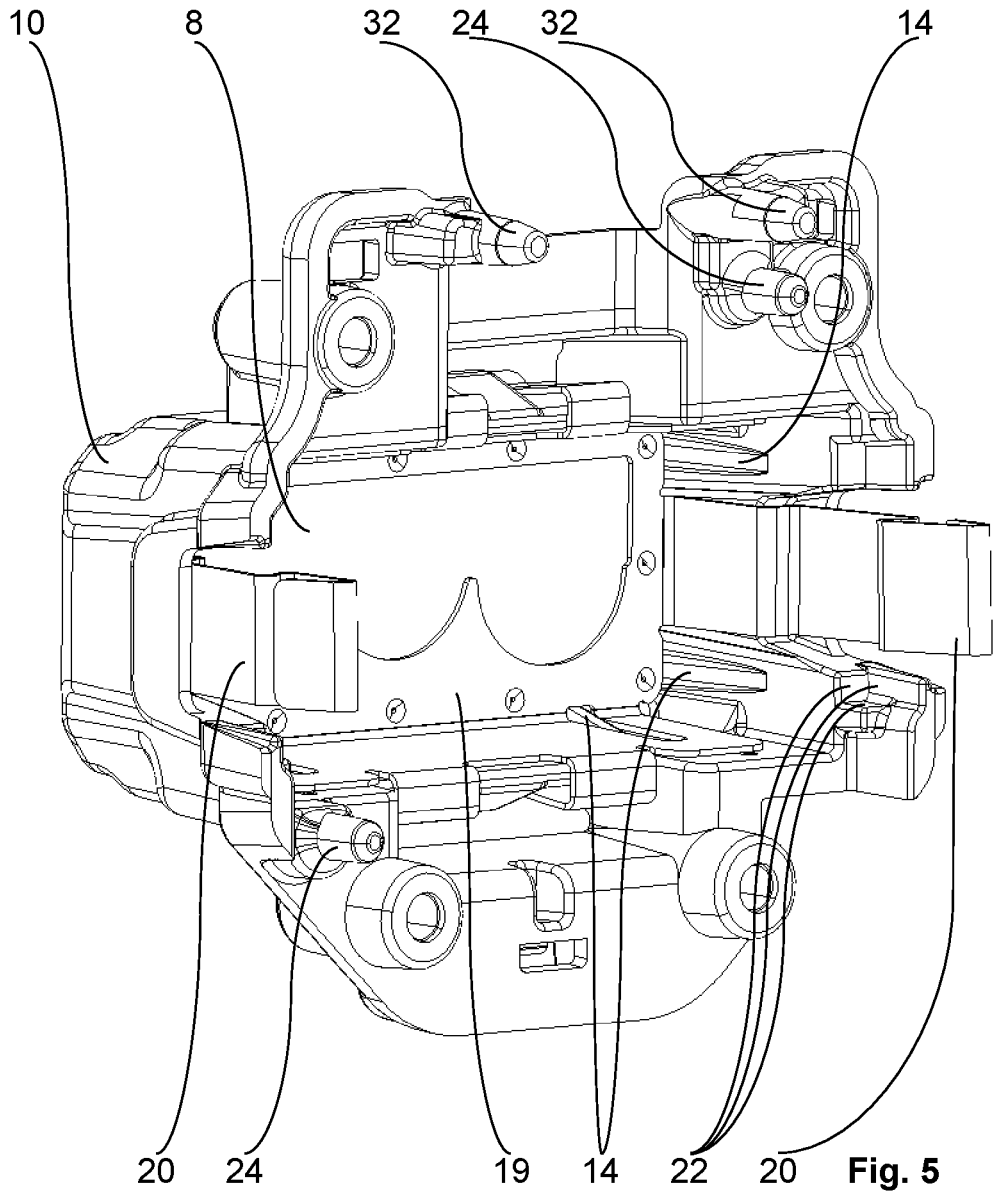
FIG. 5 shows the cover frame of FIG. 4 with the first positioning device in a representation comparable to FIG. 4.
Figure 6:
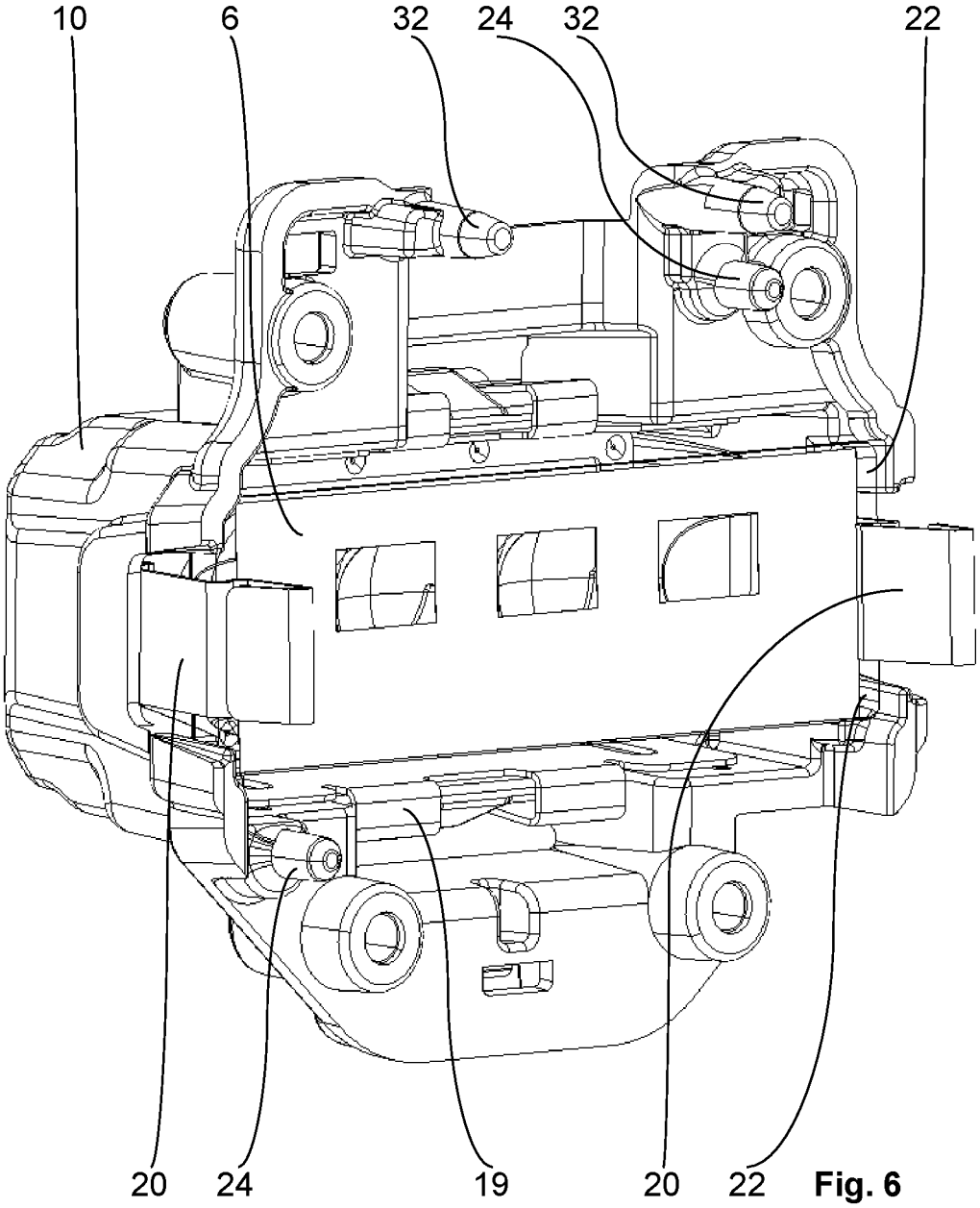
FIG. 6 shows the cover frame of FIG. 5 with the optical system in a representation comparable to FIG. 5.
Figure 7:
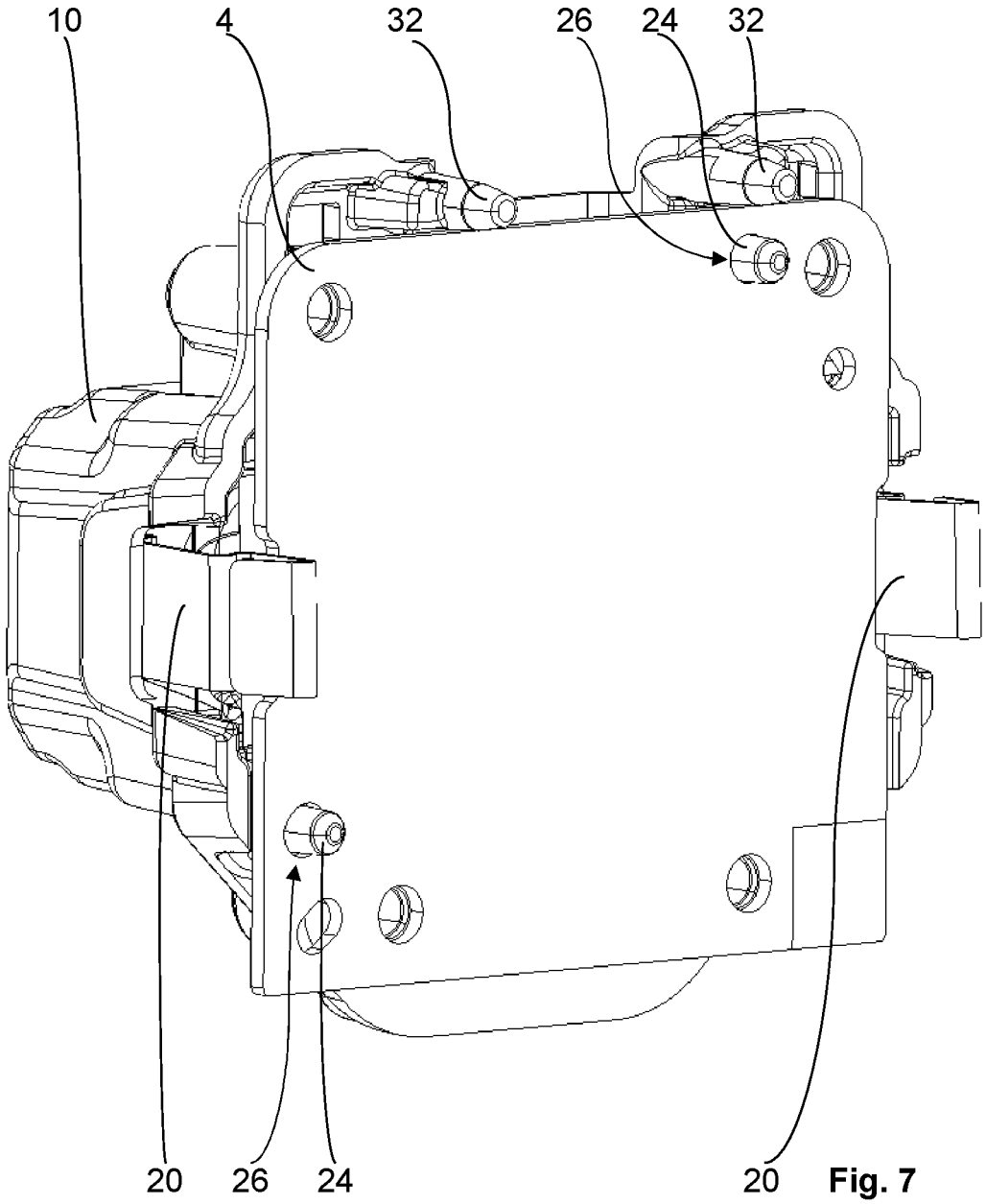
FIG. 7 shows the cover frame of FIG. 6 with the light generating unit in a representation comparable to FIG. 6.

The plurality of the positioner includes first positioner 14 for positioning the cover plate 8 relative to the cover frame 10, wherein the first positioner 14 are designed and arranged in such a way that they position the cover plate 8 in a plane perpendicular to a main light direction of the light generated by the light generating unit 4. The main direction of light is symbolized in FIG. 1 by an arrow 16. The first positioner 14 are formed as protrusions on an inner side of the cover frame 10. The inner side of the cover frame 10 faces the cover plate 8 in FIG. 1. See also FIG. 3, in which the inside of the cover frame 10 is shown in an expanded view. The first positioner 14, which are only partially visible in FIGS. 1 and 3, are equally distributed about an opening 18 in the cover frame 10.

Figure 2:
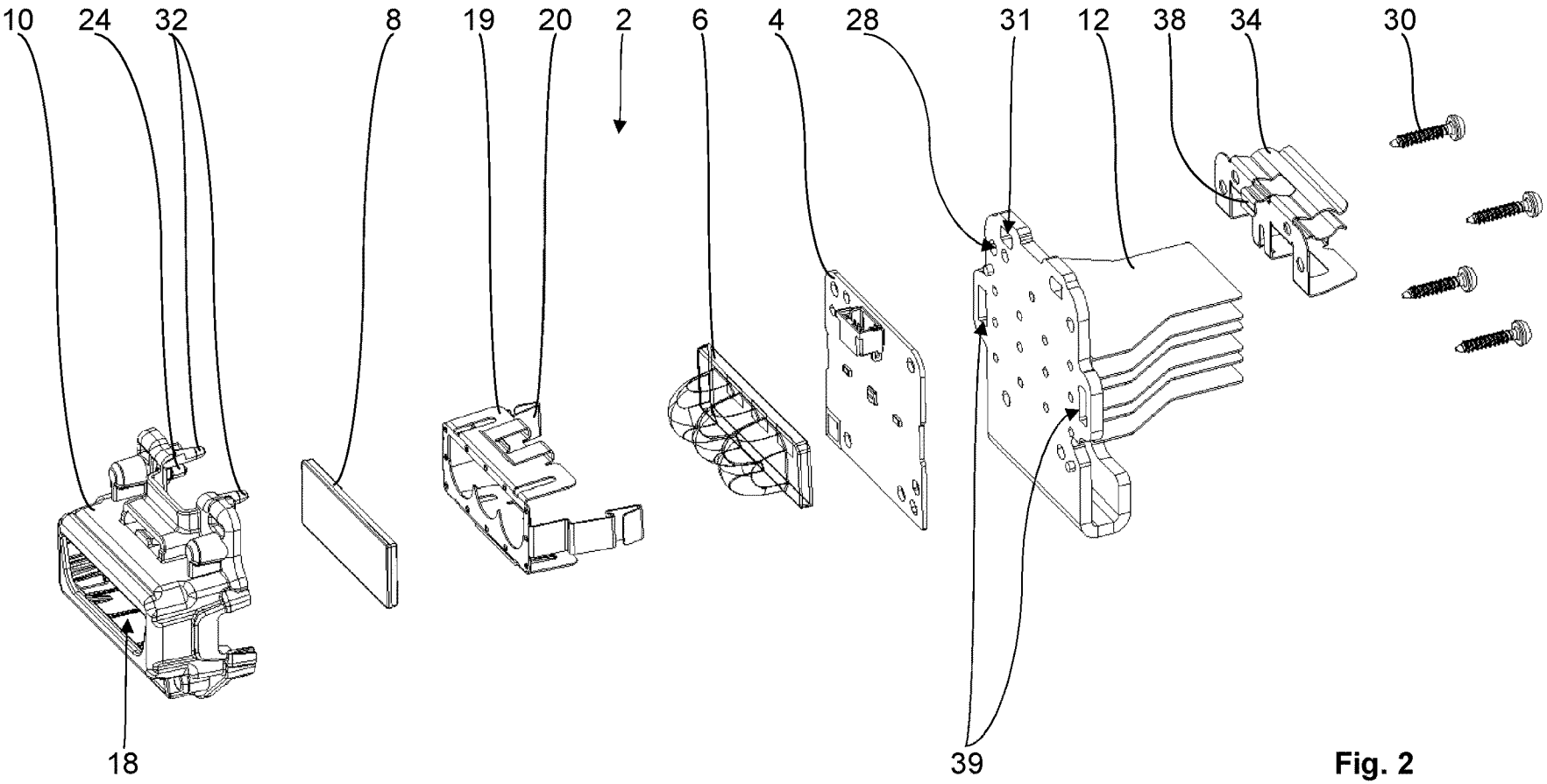
FIG. 2 shows the exemplary embodiment of FIG. 1 in a further perspective exploded view.
Figure 10:
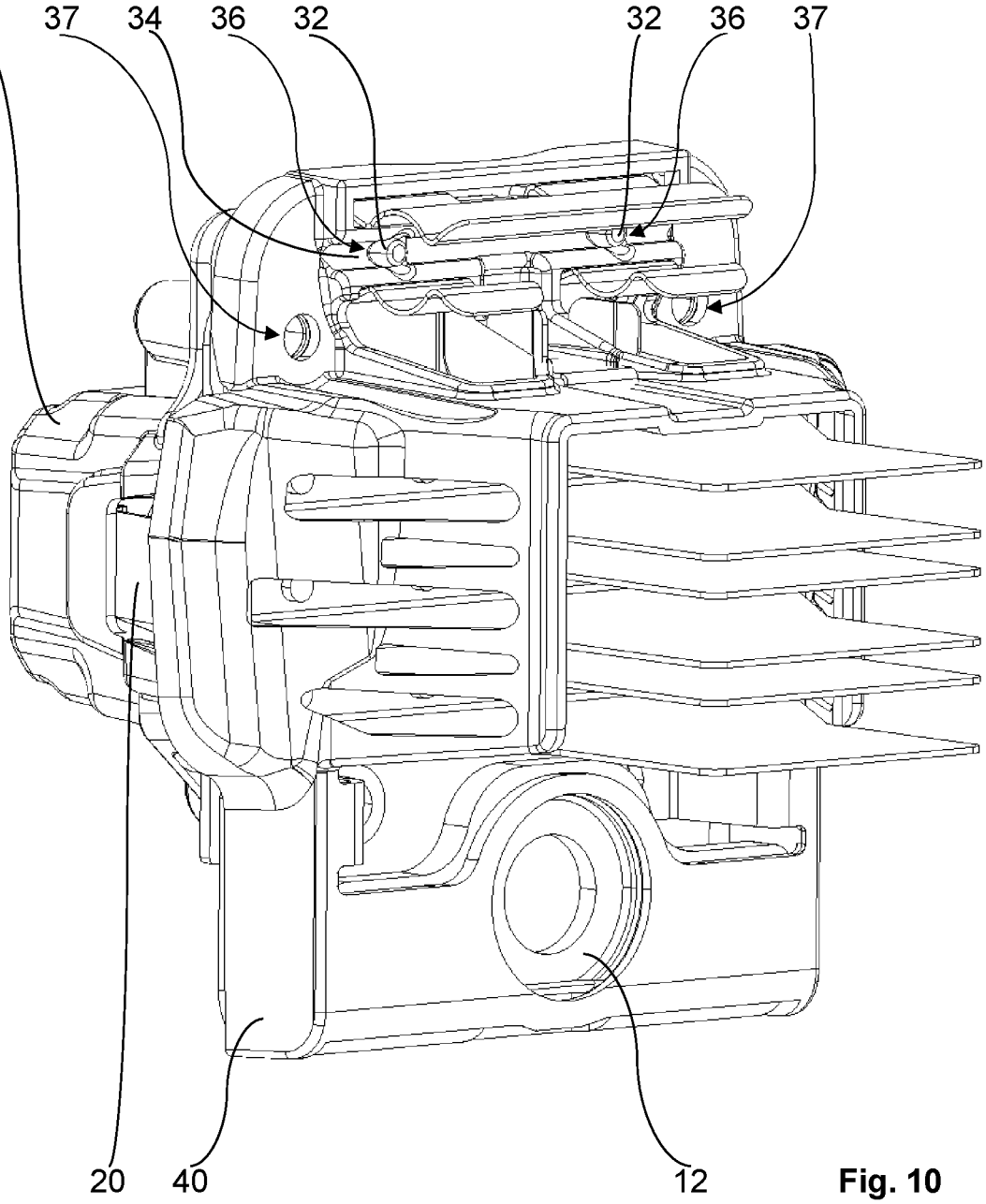
FIG. 10 shows the cover frame of FIG. 9 with a cover in a representation comparable to FIG. 9

When moving the light module 2 from a disassembled state of the light module 2 shown in FIGS. 1 and 2 into the assembled state of the light module 2 shown in FIG. 10, a user, not shown, inserts the cover plate 8 in the direction of the main light direction 16 into the cover frame 10, so that the cover plate 8 inserted in the cover frame 10 is positioned in a plane perpendicular to the main light direction 16 of the light generated by the light generating unit 4 relative to the cover frame 10. See also FIG. 4, which shows the cover plate 8, which has been inserted into the cover frame 10 and positioned perpendicular to the main direction of light 16 and relative to the cover frame 10 via the first positioner 14. Thereafter, when the light module 2 is moved into its assembled state, the cover plate 8 is fixed and positioned parallel, i.e., longitudinally, to the main light direction 16 on the cover frame 10 via a first positioning device 19 of the light module 2.

The first positioning device 19 is formed as a spring sheet, namely a single-piece sheet metal part made of sprung steel. For the purpose of fixing the cover plate 8 parallel to the main direction of light 16, the first positioning device 19 has two spring arms 20 oppositely arranged, which form a latching connection with correspondingly formed latch of the cover frame 10 in the assembled state of the light module 2. The cover plate 8 is thus positioned both in a plane perpendicular to the main light direction 16 as well as parallel to the main light direction 16 relative to the cover frame 10. Accordingly, the cover plate 8 references to the cover frame 10 of the light module 2, which is formed as the only reference part of the light module 2. As can be seen in particular from FIGS. 2 and 5, the first positioning device 19 is simultaneously formed as an aperture, wherein in the assembled state of the light module 2, the first positioning device 19 covers the edges of the individual optics of the optical system 6.

Furthermore, the plurality of the positioner of the cover frame 10 have second positioner 22 for positioning the optical system 6 relative to the cover frame 10, wherein the second positioner 22 are designed and arranged in such a way that these position the optical system 6 in a plane perpendicular to the main light direction 16 of the light generated by the light generating unit 4. The second positioner 22 are formed as shoulders on the inner side of the cover frame 10 and, analogous to the first positioner 14 of the cover frame 10, also only partially shown in FIGS. 1 and 3 to 6. The second positioner 22 are formed on the cover frame 10 corresponding to each of the four corners of the optical system 6.

When moving the light module 2 from the disassembled state of the light module 2 into the assembled state of the light module 2, the user inserts the optical system 6 in the cover frame 10 in the direction of the main light direction 16, so that the optical system inserted in the cover frame 10 is positioned in a plane perpendicular to the main light direction 16 of the light generated by the light generating unit 4 relative to the cover frame 10. See in particular FIG. 6, which shows the optical system 6 inserted into the cover frame 10 and positioned perpendicular to the main light direction 16 and relative to the cover frame 10 via the second positioning device 22. When the light module 2 is moved into its assembled state, the optical system 6 is fixed and positioned on the cover frame 10 parallel to the main light direction 16 via a second positioning device of the light module.

In the present exemplary embodiment, the second positioning device is formed as the first positioning device 19. In order to fix the optical system 6 parallel to the main light direction 16, the first positioning device 19 uses the two spring arms 20 arranged opposite one another to engage around the optical system 6 in such a way that the optical system 6 is positioned parallel, i.e., longitudinally, to the main light direction 16. The optical system 6 is thus positioned both in a plane perpendicular to the main light direction 16 as well as parallel to the main light direction 16 relative to the cover frame 10. Accordingly, the optical system 6 references, analogously to the cover plate 8, to the cover frame 10 of the light module 2, which is formed as the only reference part of the light module 2.

In addition, the cover frame 10 has third positioner 24 for positioning the light generating unit 4 relative to the cover frame 10, wherein the third positioner 24 are designed and arranged in such a way that they position the light generating unit 4 in a plane perpendicular to the main light direction 16 of the light generated by the light generating unit 4. The third positioner 24 are formed as two positioning pins, and the light generating unit 4 has openings 26 corresponding to each of the third positioner 24. See in particular FIG. 7.

When the light module 2 is moved from the disassembled state of the light module 2 into the assembled state of the light module 2, the user places the light generating unit 4 in the direction of the main light direction 16 on the cover frame 10, so that the light generating unit 4 placed on the cover frame 10 is positioned in a plane perpendicular to the main light direction 16 of the light generated via the light generating unit 4 relative to the cover frame 10. To this end, see FIG. 7, which shows the light generating unit 4 placed on the cover frame 10 and positioned perpendicular to the main light direction 16 and relative to the cover frame 10 via the third positioner 24. For the purpose of positioning the light generating unit 4 relative to the cover frame 10, when the light module 2 is transitioned to its assembled state, the openings 26 of the light generating unit 4 come into contact with the third positioner 24 of the cover frame 10 designed as positioning pins.

Thereafter, when the light module 2 is moved into its assembled state, the light generating unit 4 is fixed and positioned on the cover frame 16 parallel to the main light direction 16 via a third positioning device of the light module 2. In the present embodiment, the third positioning device is formed as the carrier 12. To this end, see FIG. 8. To fix the carrier 12 to the cover frame 10, the carrier 12 is screwed together with the cover frame 10 using four screws, wherein the carrier 12 has openings 28 for this purpose, of which only three are visible in FIG. 8. The four screws 30 are shown in FIGS. 1 and 2. The light generating unit 4 is thus positioned both in a plane perpendicular to the main light direction 16 as well as parallel to the main light direction 16 relative to the cover frame 10. Accordingly, the light generating unit 4 references to the cover frame 10 of the light module 2 formed as the only reference part of the light module 2.

Figure 8:
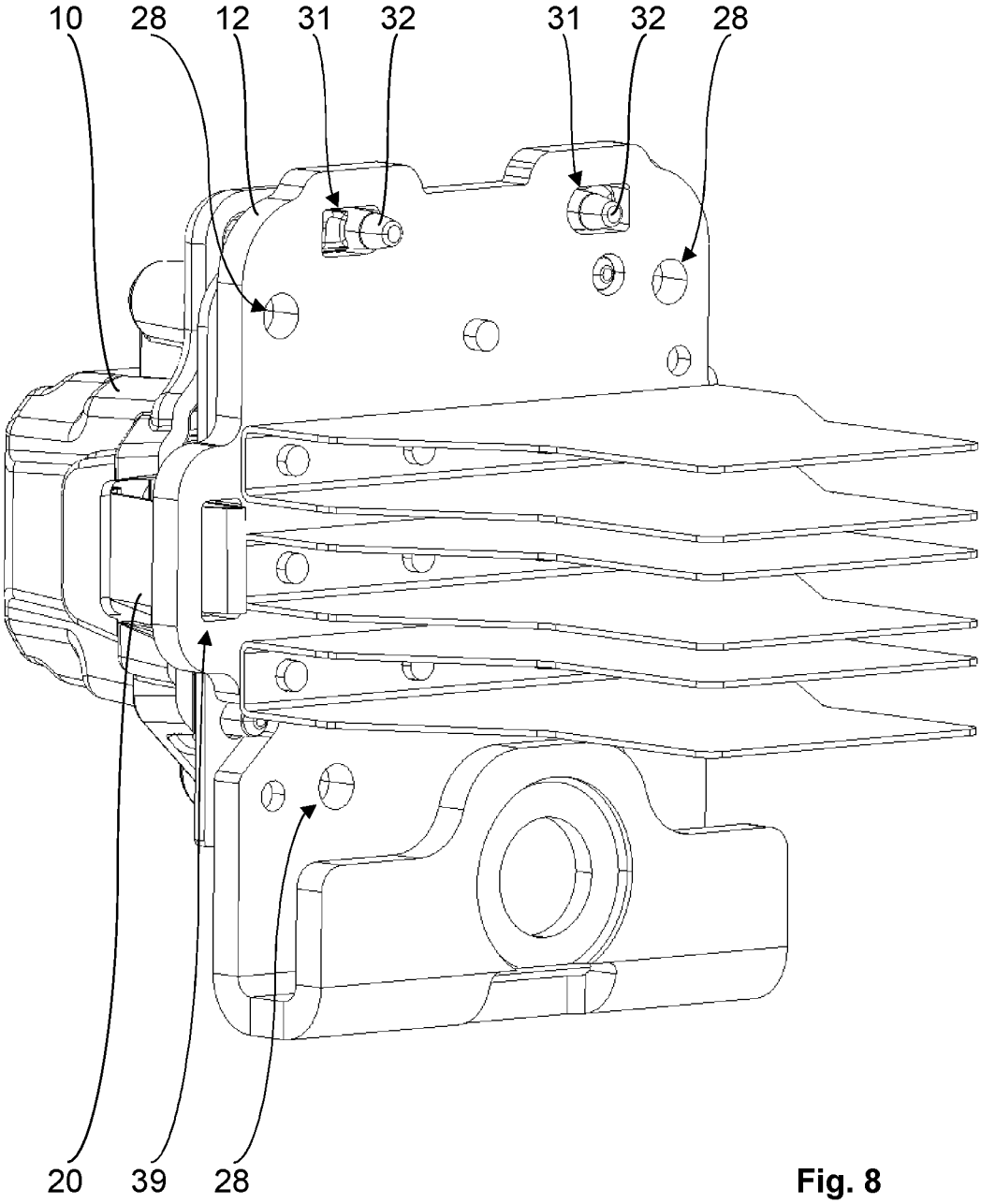
FIG. 8 shows the cover frame of FIG. 7 with the carrier in a representation comparable to FIG. 7.
Figure 9:
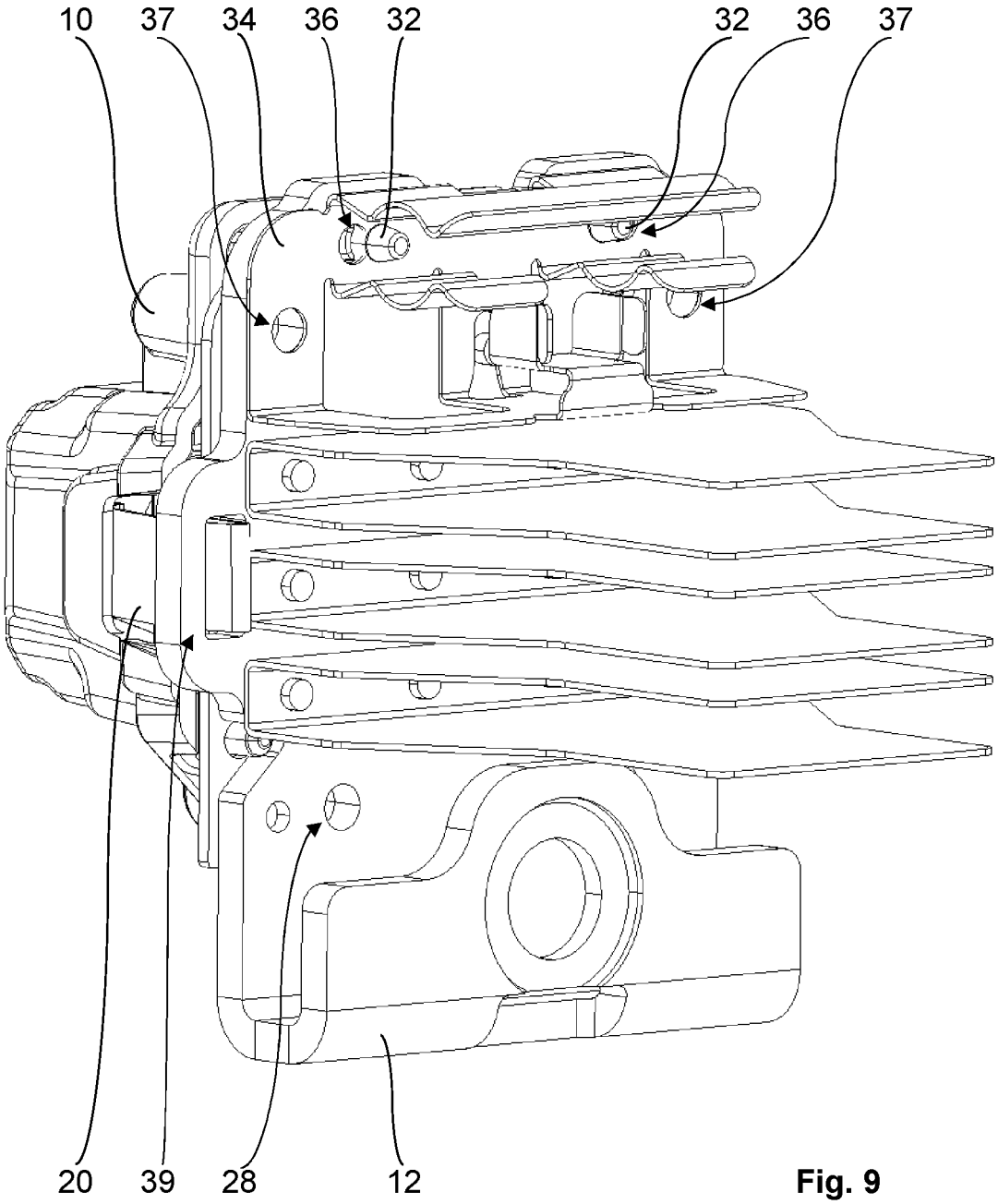
FIG. 9 shows the cover frame of FIG. 8 with the holding device in a representation comparable to FIG. 8.

As can further be seen from FIG. 8, the carrier 12 has two openings 31, through which fourth positioner 32 of the cover frame 10 formed as positioning pins protrude. These fourth positioner 32 are used for positioning a holding device 34 of the light module 2 for holding the light module 2 on the rest of the not-shown light unit relative to the cover frame 10, wherein the fourth positioner 32 are designed and arranged in such a way that these position the holding device 34 in a plane perpendicular to the main direction of light 16 of the light generated by the light generating unit 4.

When the light module 2 is moved from the disassembled state of the light module 2 into the assembled state of the light module 2, the user places the holding device 34 on the carrier 12 in the direction of the main light direction 16, so that the holding device 34 placed on the carrier 12 is positioned in a plane perpendicular to the main light direction 16 of the light generated by the light generating unit 4 relative to the cover frame 10. To this end, see FIG. 9, which shows the holding device 34 placed on the carrier 12 and positioned via the fourth positioner 32 perpendicular to the main direction of light 16 and relative to the cover frame 10. In the present exemplary embodiment, the holding device 34 is formed as a spring plate, namely as a one-piece sheet metal part made of sprung steel. For the purpose of positioning the holding device 34 relative to the cover frame 10, when moving the light module 2 into its assembled state, openings 36 of the holding device 34 formed in each case as corresponding to the fourth positioner 32 come into engagement with the fourth positioner 32 of the cover frame 10 formed as positioning pins.

Two of the above-mentioned screws 30 and two openings 37 of the holding device 34 serve to fix the holding device 34 to the carrier 12. Prior to screwing the carrier 12 to the cover frame 10, the holding device 34 is connected to the carrier 12 via the screws 30, for example via a fastening clip 38 of the holding device 34. In the assembled state of the light module 2, the holding device 34 is thus positioned both in a plane perpendicular to the main light direction 16 as well as parallel to the main light direction 16 relative to the cover frame 10. Accordingly, the holding device 34 also references to the cover frame 10 of the light module 2 formed as the only reference part of the light module 2.

As can further be seen from FIGS. 1, 2, 8 and 9, the carrier 12 has two opposing openings 39, each formed as corresponding to the spring arms 20 of the first positioning device 19 such that the spring arms 20 of the first positioning device 19 on one side and the openings 39 of the carrier 12 on the other side are each formed as mutually corresponding securing device, wherein the mutually corresponding securing device 20, 39 secure the latching mechanism of the optical system 6 via the spring arms 20 of the first positioning device 19 in the assembled state of the light module 2 shown in FIG. 10. The openings 39 of the carrier 12 are therefore not used for latching with the spring arms 20 of the first positioning device 19, but instead to hold the spring arms 20 in their position relative to the optical system 6. Accordingly, an unwanted loosening of the optical system 6 from its position in the assembled state of the light module 2 is effectively prevented in a structurally simple manner.

Finally, the light module 2, on its side facing the carrier 12 designed as a cooling element, is essentially sealed dust-tight with a cover 40 made of plastic. See FIG. 10, which shows the light module 2 in its assembled state. The cover 40 may be connected to the rest of the light module 2 in the appropriate way for the respective individual case. For example, the cover, analogous to the holding device, may be attached to the rest of the light module via the screws and the corresponding openings in the cover. Other suitable connection techniques known to the skilled person are also conceivable, such as latching connections or the like.

The invention is not limited to the present exemplary embodiment. For example, the invention can also be used advantageously in other vehicles. Furthermore, the light unit may, for example, also be designed as a vehicle light. In addition, it is possible that the fourth positioner are formed as the third positioner.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A light module of a light unit of a vehicle, the light module comprising:

a light generating unit;

an optical system;

a cover plate;

a cover frame; and a carrier, wherein the light generating unit, the optical system and the cover plate are arranged in an assembled state of the light module in the aforementioned order between the carrier and the cover frame, wherein the cover frame comprises a plurality of positioners to position the light generating unit, the optical system and the cover plate relative to the cover frame, wherein the cover plate is fixed and positioned on the cover frame substantially parallel to a main direction of light generated by the light generating unit via a first positioning device, and wherein the first positioning device has spring arms that extend through corresponding openings in the carrier.

2. The light module according to claim 1, wherein the plurality of positioners have a first positioner for positioning the cover plate relative to the cover frame, wherein the first positioner is designed and arranged in such a way that the first positioner positions the cover plate in a plane substantially perpendicular to the main direction of light of the light generated via the light generating unit.

3. The light module according to claim 2, wherein the plurality of positioners have a second positioner to position the optical system relative to the cover frame, wherein the second positioner is designed and arranged in such a way that the second positioner positions the optical system in a plane substantially perpendicular to the main direction of light of the light generated by the light generating unit.

4. The light module according to claim 3, wherein the plurality of positioners have a third positioner to position the light generating unit relative to the cover frame, wherein the third positioner is formed and arranged in such a way that the third positioner positions the light generating unit in a plane substantially perpendicular to the main direction of light of the light generated by the light generating unit.

5. The light module according to claim 4, wherein the plurality of positioners have a fourth positioner to position a holding device of the light module for holding the light module on the rest of the light unit relative to the cover frame, wherein the fourth positioner is designed and arranged in such a way that the fourth positioner positions the holding device in a plane substantially perpendicular to the main light direction of the light generated by the light generating unit.

6. The light module according to claim 5, wherein the fourth positioner is formed as the third positioner.

7. The light module according to claim 5, wherein the fourth positioner is a positioning pin that protrudes parallel to the main direction of light and extends through a corresponding opening in the holding device.

8. The light module according to claim 4, wherein the third positioner is a positioning pin that protrudes parallel to the main direction of light and extends through a corresponding opening in the light generating unit.

9. The light module according to claim 3, wherein the second positioner is a recess formed in an inner side wall of the cover frame, and wherein in the main direction of the light, the second positioner is positioned upstream from the first positioner.

10. The light module according to claim 1, wherein the optical system is fixed and positioned on the cover frame substantially parallel to the main direction of light via a second positioning device of the light module or wherein the second positioning device is formed as the first positioning device.

11. The light module according to claim 10, wherein the light generating unit is fixed and positioned on the cover frame substantially parallel to the main light direction via a third positioning device of the light module or wherein the third positioning device is formed as the carrier.

12. The light module according to claim 10, wherein the first and/or the second positioning device are designed such that the first and/or the second positioning device latches with the cover plate and/or the optical system.

13. The light module according to claim 12, wherein the first and/or the second positioning device and the cover frame each have a mutually corresponding securing device, wherein the mutually corresponding securing device secures latching between the first and/or the second positioning device with the cover frame in the assembled state of the light module.

14. The light module according to claim 13, further comprising screws that secure the carrier to the cover frame.

15. The light module according to claim 10, wherein the second positioning device directly contacts the cover frame.

16. A light unit of a vehicle, comprising a light module according to claim 1.

* * * * *